United States Patent [19]

Stoltzfus et al.

[11] 3,979,076

[45] Sept. 7, 1976

[54] GRINDING WHEEL GUIDE MEANS FOR FORAGE HARVESTER

[75] Inventors: David D. Stoltzfus, Gordonville; Benjamin H. Snavely, New Holland, both of Pa.

[73] Assignee: Sperry Rand Corporation, New Holland, Pa.

[22] Filed: June 18, 1975

[21] Appl. No.: 588,095

[52] U.S. Cl. ..... 241/101.2; 51/249

[51] Int. Cl.[2] ..... B24B 19/00

[58] Field of Search ..... 241/101.2; 51/249

[56] References Cited

UNITED STATES PATENTS

| | | | |
|---|---|---|---|
| 3,581,446 | 6/1971 | Witt et al. | 51/249 |
| 3,638,363 | 2/1972 | Witt et al. | 51/249 |

*Primary Examiner*—Granville Y. Custer, Jr.
*Attorney, Agent, or Firm*—C. Hercus Just; Frank A. Seemar; John R. Flanagan

[57] ABSTRACT

A forage harvester having a rotatable cutter head co-acting with a shear bar is provided with a grinding wheel which is power driven and adapted to be moved longitudinally along transversely extending guide means adjacent the circumferential outline of the cutting edges of the knives of the cutter head while the grinding wheel is rotating. When the guide means is in one position, the grinding wheel is positioned to sharpen the cutting edges of the knives and, when one end of the guide means is shifted to a second position, the grinding wheel will be positioned to grind bevelled surfaces of uniform depth and width along said knives rearwardly of the newly sharpened cutting edges thereof.

4 Claims, 9 Drawing Figures

GRINDING WHEEL GUIDE MEANS FOR FORAGE HARVESTER

CROSS-REFERENCE TO RELATED APPLICATION

The invention comprising the subject matter of the present application Ser. No. 583,067 is related to a co-pending application filed June 2, 1975, and commonly assigned therewith to the same assignee, said co-pending application being entitled Cutter Head Rotating Mechanism For Forage Harvester.

BACKGROUND OF THE INVENTION

Forage harvesters of the type to which the present invention pertains employ relatively heavy and large rotatable cutter head having a plurality of knives thereon which are spaced even distances circumferentially around the cutter head. Normally, said knives are arranged upon the periphery of the cutter head at an angle to the axis thereof as well as at an angle to the shear bar, it being understood that the shear bar normally is mounted stationarily within the harvester in parallel relation to the periphery of the cutting head, whereby during the shearing operation, no sudden shock is imposed upon the knives of the cutter head or the shear bar as occurs when the rotatable knives and shear bar as occurs when the rotatable knives and shear bar are mounted in parallel relationship to each other. Also, said knives preferably are skewed in order to dispose the cutting edges thereof within the circumferential cylindrical outline of the cutter head in order to have the cutting edges of the knives operate in shearing manner with the relatively straight cutting edge of the shear bar.

It is also conventional at present to include in a forage harvester of the foregoing type a power-driven, rotatable grinding wheel as part of the standard equipment of said harvester. Guide means are also included adjacent the periphery of the cutter head along which the grinding wheel is moved in grinding relationship relative to the knives. When the guide means is disposed parallel to the shear bar and the axis of the cutter head, the grinding wheel will be positioned to grind the cutting edges of the knives. However, in order to complete the sharpening operation, it is necessary to grind a bevel surface immediately rearward of the sharpened cutting edges, said bevel being slightly concave in cross-section and the same preferably is of uniform depth and width along the full length of the knives.

For purposes of minimizing the inventory of knives for such cutter heads, it has been found that when, for example, the same knives are used on cutter heads which respectively are of eighteen inch and twenty four inch diameters, problems arise with respect to grinding the bevels on the knives immediately rearward of the cutting edges. This is especially found to exist when knives originally manufactured for a cutter head of eighteen inch diameter are employed upon a cutter head having a twenty four inch diameter. Thus, it has been found that when the foregoing situation exists, and the guide for the grinding wheel is left in its parallel position with the shear bar after sharpening all of the cutting edges of the knives, and each knife then is individually ground by the grinding wheel to re-surface the bevel rearwardly of each cutting edge, the bevel is substantially wider at one end of the knife than at the other and is preferred that the bevel be of uniform width along the entire length of each knife so as to provide a shearing surface of uniform width on the cutting edge of each knife. Accordingly, the present invention has been devised to permit the use of one type of knife on two different diameters of cutter heads and also enable the grinding wheel of the forage harvester to not only sharpen the cutting edges but also grind bevels of uniform depth and width rearward of each cutting edge, by means described hereinafter.

To provide an understanding of the details of the type of forage harvesters to which the present invention pertains, attention is directed to prior U.S. Pat. Nos. 3,751,859 in the name of P. K. Pederson, dated Aug. 14, 1973; 3,793,792 in the names of R. A. Wagstaff and T. W. Waldorp, dated Feb. 26, 1974; and 3,863,403, in the name of P. F. Fleming, dated Feb. 4, 1975. In all of these previous patented structures, grinding wheels and means to guide the same are illustrated but none of them propose solutions to the problem which is solved by the present invention, namely, providing guide means for skewed knives which are made for one diameter of cutter head and are employed on a cutter head of a different and especially a larger diameter, and still be able to grind a bevel surface of uniform depth and width along the full length of each knife.

SUMMARY OF THE INVENTION

It is the principal purpose of the present invention to provide guide means for a head which supports a rotatable grinding wheel which is operated by power means and is guided for movement along the cutting edges of each knife of the cutter head from one end to the other of each knife, said guide means when in a first position parallel to the shear bar positions the grinding wheel to grind uniform cutting edges on each knife in succession as, for example, the cutter head is rotated by the power means that normally drives it while the head of the grinding wheel traverses the guide means therefor between opposite ends thereof incident to grinding the cutting edges and the improvement of the present invention comprising the addition of means by which at least a part of the guide means for the head that supports the grinding wheel is shifted to a second position in which it is arranged to guide said head and grinding wheel thereon in a manner to grind bevel surfaces of slightly concave nature in cross-section immediately rearward of the cutting edge of each knife, said bevel surfaces being of uniform depth and width for the full length of each knife.

It is another object of the invention to provide in the improvement of the present invention a pair of guide bars which extend transversely between opposite sides of the housing within which the cutter head rotates, said pair of guide bars guiding spaced means on the head which carries the grinding wheel, one of said bars always being parallel to the shear bar and axis of the cutter head but is movable radially toward and from operative position with respect to the cutting edges of the knives of the cutter head, and the second bar having one end fixedly positioned with respect to one side of the housing within which the cutter head rotates while the opposite end of said second guide bar is shiftable between two different positions, one of said positions being that in which the second guide bar is parallel to the first one and also parallel to the shear bar, while in the second position, said guide bar is disposed with one end shifted to a second position which compensates for the difference in skew between knives as employed upon the cutter head but made for a cutter head of different diameter and knives which would be made for the cutter head of the diameter employed in the machine.

It is a further object of the invention to provide relatively simple means by which said one end of the second guide bar is shifted between the two different operative positons thereof respectively employed to sharpen the cutting edge of the knives and grind the bevel surface rearward of each cutting edge on the knives, said simple means comprising an eccentric operated by a lever which is movable through an arc of approximately 180° and stop means are provided for engagement by the lever respectively when in one position or the other, depending upon whether the grinding wheel is to be used to sharpen the cutting edges or grind the bevel surface rearwardly of the cutting edges on the knives.

Details of the foregoing objects of the invention, as well as other objects thereof, are set forth in the following specification and illustrated in the accompanying drawings comprising a part thereof.

DETAILED DESCRIPTION

Figure 1:
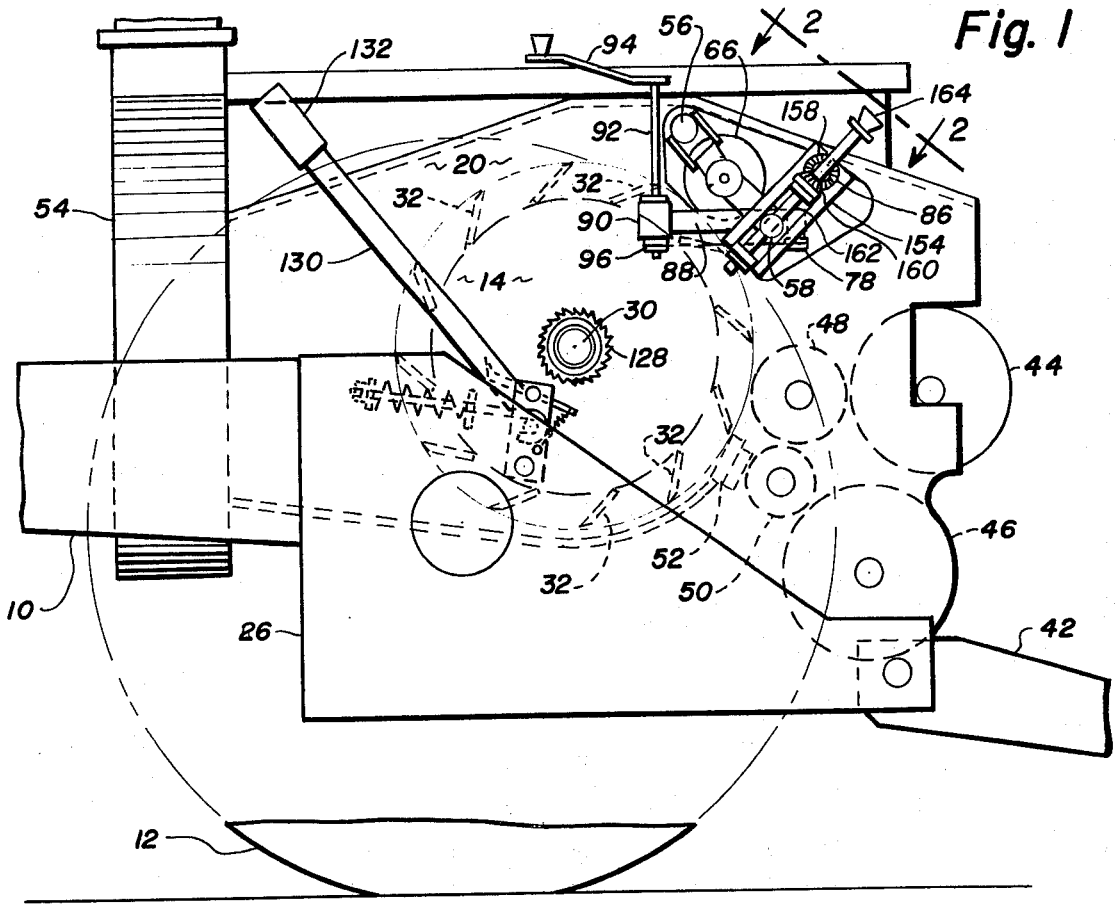
FIG. 1 is a fragmentary side elevation showing the portion of a forage harvester and particularly the area thereof in which the cutter head is mounted for coaction with the shear bar and said view also illustrating means for supporting and operating the power-driven grinding wheel by which both the cutting edges of the knives of the cutter head are sharpened and, when the position of the grinding wheel is shifted, the same is employed to re-grind the bevel surface on each knife immediately rearward of the cutting edge thereof.

Referring to FIG. 1, an exemplary forage harvester of the type to which the present invention pertains is shown fragmentarily in side elevation. Said harvester is of the mobile type and includes a frame 10 and a pair of forward driving wheel 12, only one of which is shown. The harvester also includes a pair of rear wheels, not shown. An appropriate prime mover, such as a diesel engine, also is supported by the frame 10 but is not illustrated since it is of conventional type. Said prime mover also is suitable connected by transmission means and otherwise to the cutter head 14 which is mounted within a housing 16, see FIG. 2, which has opposite side plates 18 and 20, which is respectively slightly spaced from the opposite ends of the cutter head 14. An appropriate top cover 22 also is shown fragmentarily in FIG. 2, whereby the cutter head 14 rotates in a completely enclosed manner both while the same is shearing and comminuting crop material as well as when the cutting edges of the knives are being sharpened.

Figure 2:
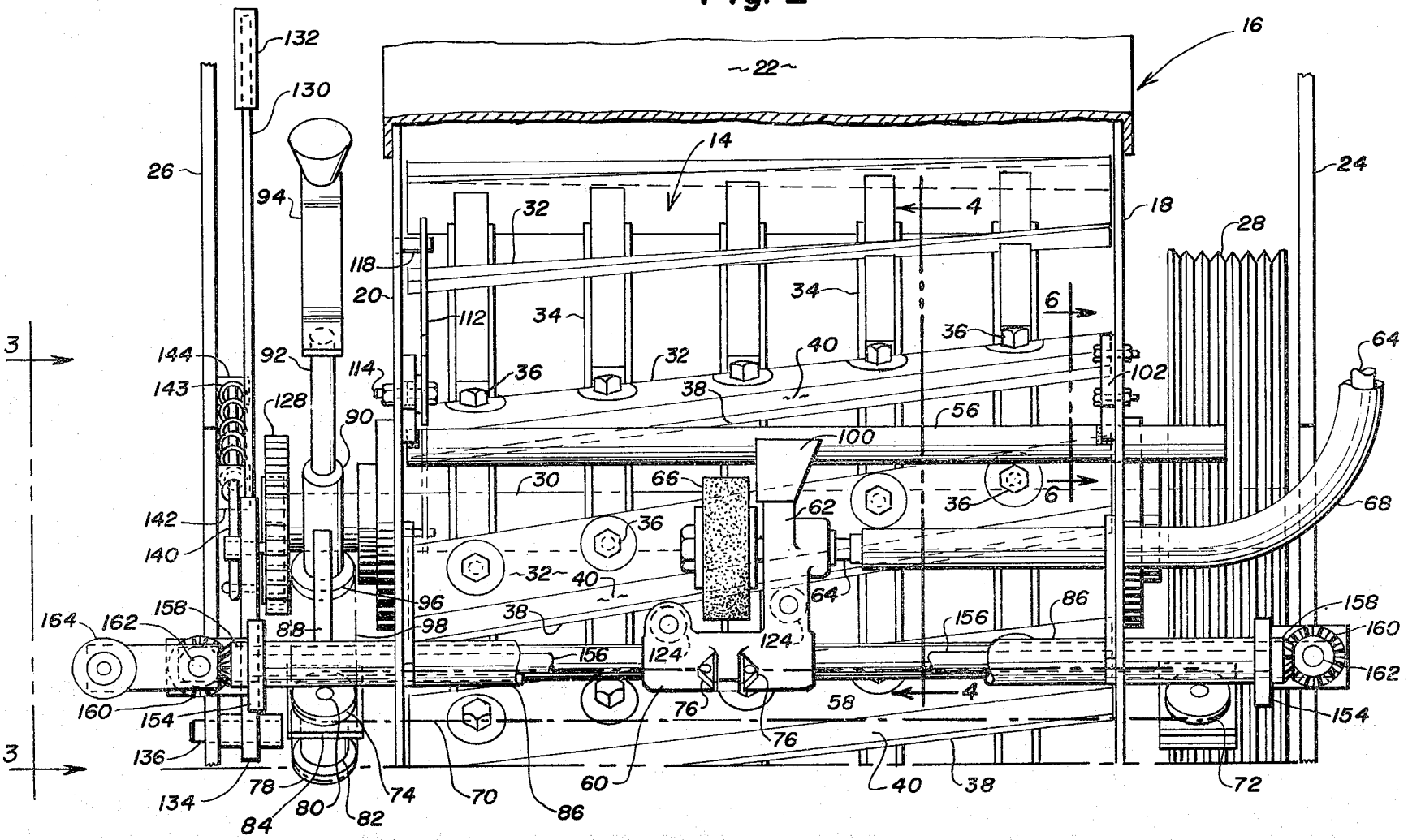
FIG. 2 is a fragmentary, further enlarged elevation somewhat in the nature of a plan view which illustrates the cutter head and guide means for the grinding wheel as well as means to effect traversing of the grinding wheel as well as means to effect traversing of the grinding wheel along the cutting edges of the knives to grind the bevel surfaces therein, as seen along the line 2—2 of FIG. 1.

The housing 16 is positioned between opposite side plates 24 and 26 which are stationarily supported by the frame 10, as best shown in FIG. 2. FIG. 2 also illustrates a large sheave 28 which is fixed to end of the drive shaft 30 of cutter head 14, which is connected to the prime mover.

From FIG. 2, it will also be seen that the cutter head 14 comprises a plurality of skewed knives 32 which are mounted circumferentially at evenly spaced locations upon a plurality of discs or spiders 34 and fixed relative to drive shaft 30. The knives 32 are secured to said discs or spiders 34 by suitable bolts 36. From FIGS. 4 and 5 particularly, it will be seen that the knives 32 have a sharpened cutting edge 38 and a slightly concave bevel surface 40.

Referring to FIG. 1, it will be seen that there is attached to the forward end of the frame 10 an arm 42 which is fragmentarily shown, said machine having a pair of such arms for supporting a header, not shown, which is provided with conventional cutters to sever the stalks or stems of forage crops to be harvested, and augers or other suitable means to condense the cut crop transversely to feed the same to an initial pair of feed rolls 44 and 46 and directly rearward of the same is a second pair of feed rolls 48 and 50 which deliver the cut material to the cutter head 14 and the knives 32 thereon co-act in shearing relationship with a stationary shear bar 52. The comminuted material is than directed to a blower 54, which is fragmentarily illustrated in FIG. 1 and said blower may be employed to deliver the comminuted material either to a suitable wagon or the like connected rearwardly to the harvester or the blower may deliver the comminuted material to a silo if the harvester is employed for that purpose.

The present invention primarily is concerned with the grinding wheel by which the cutting edge 38 as well as the bevel surface 40 on each knife 32 may be ground either while the harvester is " in the field " or otherwise. Such grinding mechanism is selfcontained in the harvester and normally is disposed in inoperative position. Details of the grinding mechanism are best shown in FIGS. 2 and 4–9. Said mechanism comprises an upper guide bar 56, one end of which is shiftable between two different operative positions which are described in detail hereinafter. A lower guide bar 58 slidably supports a guide sleeve 60. The guide bars 56 and 58 both extend between the inner surfaces of the side plates 18 and 20 of housing 16 in which the cutter head 14 operates. The lower guide bar 58 is movable in a substantially radial direction with respect to the drive shaft 30, as can be visualized best from FIG. 1. The mechanism to accomplish this is described in detail hereinafter. Guide sleeve 60 is part of a head 62 which contains a bearing through which a flexible drive shaft 64 extends, see FIG. 2, to support an abrasive grinding wheel 66 on the outer end thereof. The flexible shaft 64 is enclosed within a flexible tube 68 which is fragmentarily shown in FIG. 2, the unillustrated remaining portion thereof being connected to the prime mover of the forage harvester which also is not illustrated but is referred to above. Said mechanism also includes an appropriate clutch of conventional nature so that the grinding wheel 66 normally is inoperative while the cutter head 14 is operated and under which circumstances the grinding wheel 66 normally is disposed adjacent one side of the housing 16 and is radially spaced from the path of movement of the cutting edges 38 of the knives 32 and in which position, for example, it is maintained by the lower guide shaft 58 being disposed in the phantom position thereof shown in FIG. 5, to which position it is moved by adjusting means described in detail hereinafter.

Head 62 which supports the grinding wheel 68 is moved in traversing manner between opposite sides of the housing 16 by a flexible member 70 which preferably comprises a sprocket chain that extends around a pair of sprocket gears 72 and 74 and opposite ends of the chain 70 respectively are connected to securing member 76 on guide sleeve 60. Flexible chain 70 is operated by means of another sprocket gear 78 which is secured to the opposite end of a short shaft 80 supported within a suitable bearing member 82 which is fixed to a bracket 84, see FIG. 2, which is connected to and carried by sleeve 86 which is fragmentarily illustrated in FIG. 2, said sleeve extending between and projecting through appropriate openings in the side plates 18 and 20 of housing 16. As also shown in FIG. 2, a plate 88 also is connected at one end to tube 86 and the opposite ends of plate 88 support a bearing sleeve 90 through which a crank shaft 92 extends. A manually operable crank 94 is connected to the upper end of shaft 92, as also is shown in FIG. 1, and another sprocket gear 96 is connected to the lower end of shaft 92 and sprocket chain 98 extends around sprocket gears 78 and 96. Operation of the crank 94 in opposite directions respectively moves the head 62 which carries grinding wheel 66 in traversing manner between opposite sides 18 and 20 of housing 16 and the grinding wheel 66 is accurately guided by means of the guide sleeve 60 sliding upon the lower guide bar 58 and the upper guide bar 56 being slidably engaged by an upper yoke-like guide shoe 100, details of which are best shown in FIGS. 4 and 5.

Figure 5:
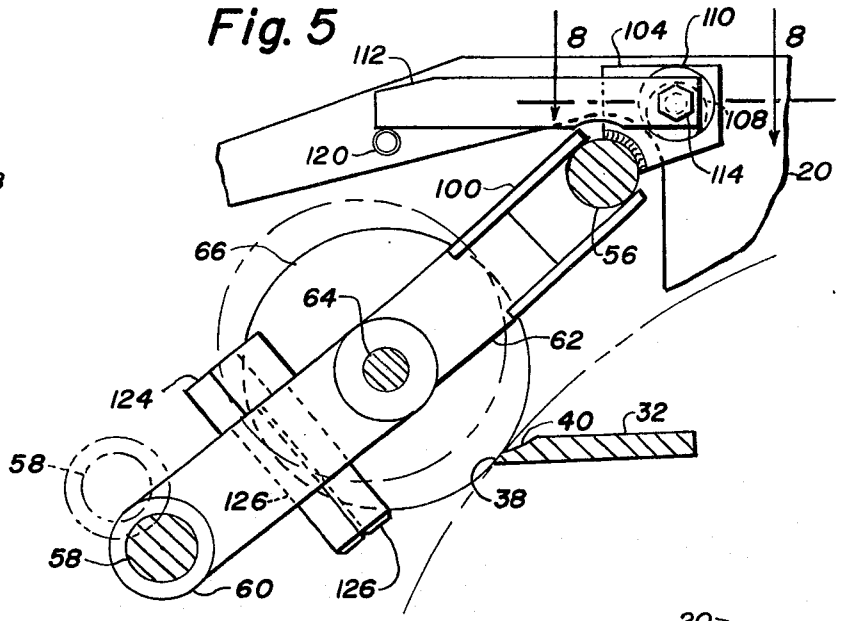
FIG. 5 is a view similar to FIG. 4 but showing the guide means in a second, shifted position from that shown in FIG. 4 and in which the grinding wheel sharpens the cutting edges of the knives.
Figure 9:
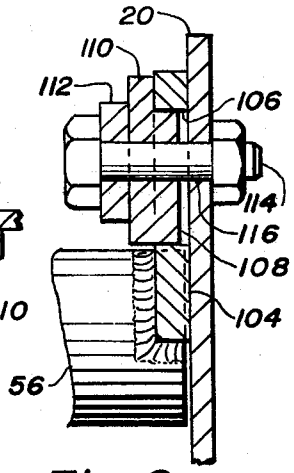
FIG. 9 is a fragmentary vertical sectional view of the details shown in FIG. 8 as seen on the line 9—9 of said figure.
Figure 8:
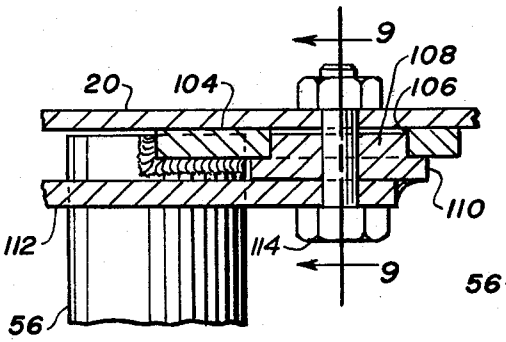
FIG. 8 is a fragmentary transverse sectional view showing details of the eccentric by which the shiftable end of the guide bar for the grinding wheel is effected, as seen on the line 8—8 of FIG. 5 but being illustrated on a substantially larger scale than employed in FIG. 5.
Figure 6:
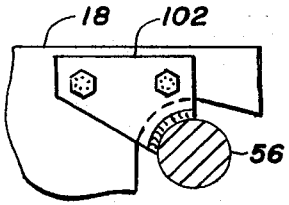
FIG. 6 is a fragmentary vertical sectional view illustrating the mount by which one end of the shiftable guide bar is fixedly positioned adjacent one side of the housing for the cutter head, as seen on the line 6—6 of FIG. 2.

As indicated above, one end of upper guide bar 56 is fixed relative to side plate 18 of housing 16 by means of a bracket 102 which is welded to said end of the bar 56 as clearly shown in FIG. 6, said bracket being attached by appropriate bolts to side plate 18. The opposite end of upper guide bar 56 however is shiftable between two different positions respectively illustrated in FIGS. 4 and 5. To accomplish this, said opposite end of the upper guide bar 56 is secured by welding to a shiftable bracket 104. The bracket 104 has a circular opening 106 therein which receives a circular eccentric 108 and the axis of said circular eccentric is offset with respect to a circular support 110 which slidably rides against the inner face of bracket 104, as clearly shown in FIGS. 8 and 9. Secured against the outer face of circular support 110 is an operating lever 112 which is secured by appropriate clamping means such as pivot bolt 114 against the outer face of circular support 110, whereby the circular eccentric 108, circular support 110 and operating lever 112 move as a unit about the axis of pivot bolt 114 which extends through an appropriate opening 116 in side plate 18.

Figure 4:
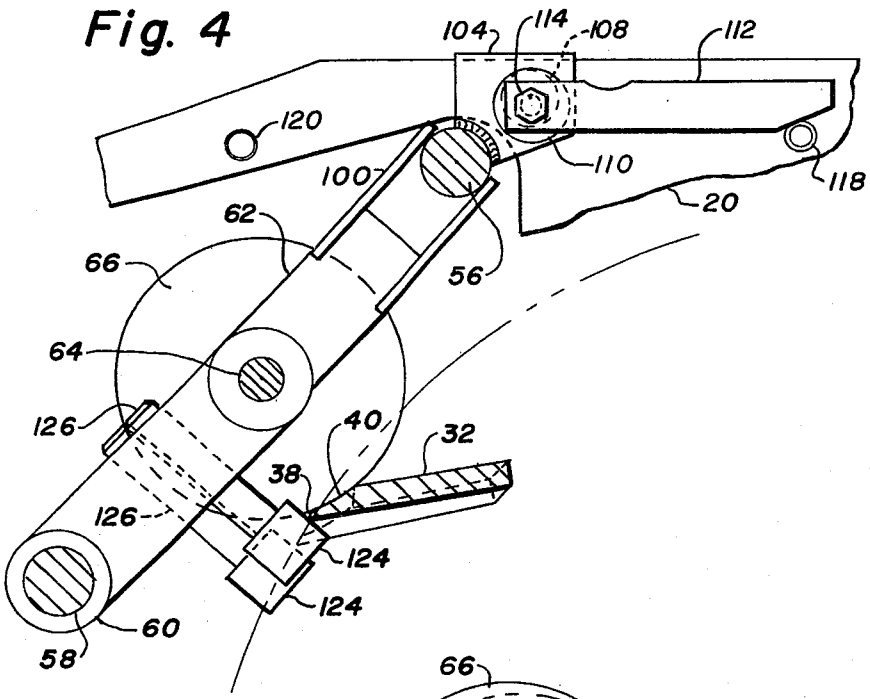
FIG. 4 is a fragmentary vertical sectional view of guide means for the grinding wheel as seen on the line 4—4 of FIG. 2, said position being that in which the guide means is disposed to position the grinding wheel to grind bevelled surfaces of the knives.
Figure 7:
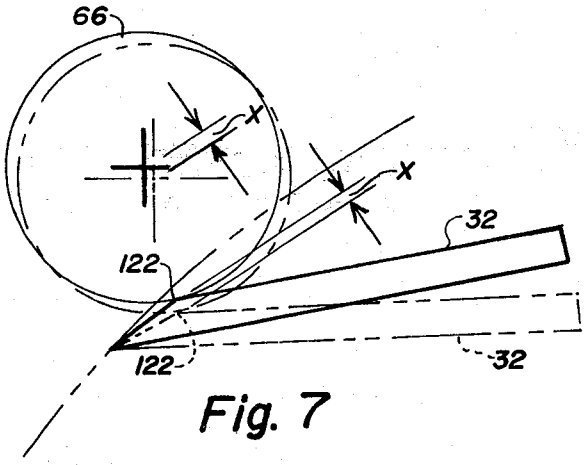
FIG. 7 is a fragmentary diagrammatic view illustrating the approximate shift in position between the opposite ends of the shiftable guide bar for the grinding wheel to compensate for the different positions of the opposite ends of the bevel surface between the relatively skewed opposite ends of each knife, one end of the knife being shown in full lines and the opposite end being shown in phantom to illustrate the different position in the portions of the cutting edges of the knives in which the bevel surface is to be ground.

As described above, one end of bar 56 is fixed relative to side plate 18 by means of bracket 102 which is welded to said one end of bar 56, and the opposite end of bar 56 is shiftable to slightly change the angularity of the bar to change the position of engagement of grinding wheel 66 respectively with sharpened cutting edge 38 and concave level surface 40, as respectively shown in FIGS. 4 and 5. To permit such angular shifting of bar 56 at said one end which is fixed relative to side plate 18, said plate is formed from sheet steel which is slightly flexible, sufficient to flex without permanent deformation when such shifting of bar 56 occurs and no bending of said bar takes place.

Also fixed to side plate 18 are a pair of stops 118 and 120 which are best shown in FIG. 4. They respectively position the lever 112 in the two shiftable positions of said movable end of upper guide bar 56.

As indicated hereinabove from the position of the circular eccentric 108 respectively shown in FIGS. 4 and 5, it will be seen that when the eccentric is in the position in FIG. 4, the grinding wheel 66 will be positioned to grind the bevel surface 40 on each knife 32, whereas when the circular eccentric 108 is in the position shown in FIG. 5, the grinding wheel 66 will be in position to sharpen the cutting edges 38 of each of the knives 32. Also, when in the latter position shown in FIG. 5, the upper guide bar 56 is subsstantially parallel to the lower guide bar 58 and also to the axis of the drive shaft 30 of the cutter head 14. Hence, to sharpen the cutting edges 38, the prime mover is connected to the cutter head 14 and rotates it in counterclockwise direction as viewed in FIGS. 4 and 5 and the grinding wheel 66 is rotated by being connected to said prime mover in a manner to sharpen the cutting edges 38 and during such procedure, the hand crank 94 is manipulated by an operator to effect traversing of the grinding wheel 66 between opposite ends of the cutter head 14 so that all of the cutting edges 38 of the knives 32 are sharpened uniformly. However, because of the skewed shape of the knives 32 and particularly in view of the fact that said skewed shape primarily is that which is designed to operate on a cutter head of smaller diameter, it is necessary to shift the movable end of the upper guide bar 56 to the position shown in FIG. 4. The reason for this is illustrated diagrammatically in FIG. 7 wherein it will be seen that the skewed disposition of the opposite ends of the knives 32 dispose the crests 122 of the cutting edges of the knives 32, which are ground away to form the bevel surfaces 40 rearwardly of the cutting edges 38, are off-set from each other a distance designated X and it is necessary for the opposite ends of the axis of the grinding wheel 66 to be similarly offset a distance designated X in said diagrammatical figure in traveling between the opposite ends of the knives 32. Accordingly, the shifting cam 108 accomplishes the necessary compensation to enable the grinding wheel 66 to produce a bevel surface 40 which is of uniform depth and width across the entire length of each knife 32. It also should be understood that when the bevel surfaces 40 are being ground in the knives 32 the cutter head is not being rotated by the prime mover and is disconnected therefrom but, however, it is essential that pressure be exerted upon the knives 32 while the bevel surfaces are being ground therein and such pressure is provided by causing the individual knives 32, as they are having the bevel surface 40 ground therein, to be tensioned toward the grinding wheel by mechanism now to be described.

Although the mechanism described hereinafter performs a function of advancing the cutter head 14 stepwise for purposes of inspecting the knives either before or after sharpening the same or grinding the bevel surfaces thereon, it also serves the additional function of tensioning the knives of the cutter head in the operative direction thereof, that is, toward the shear bar 52 in order that the grinding wheel 66, in traversing each knife from the right hand side to the left hand side, as viewed in FIG. 2, resists movement in the opposite direction as such movement is induced by engagement of the rollers 124, which are disposed in suitable openings 126 which receive the shafts thereof, said openings extending transversely through the head 62 between the shaft 64 and the guide bar 58, as can clearly be seen from FIGS. 4 and 5.

As indicated, grinding of the bevel surfaces 40 preferably is initiated adjacent the right hand end of the knives 32, as viewed in FIG. 2, whereby as the head 62 which carries the grinding wheel 66 therewith moves to the left as viewed in said figure, the rollers 124 engage the cutting edge 38 of each knife and roll therealong and, in doing so, urge the knives 32 upwardly as viewed in FIG. 2 but such movement is yieldably opposed by the tensioning means referred to above. It also is to be understood that when the grinding wheel 66 is grinding the cutting edges 38 of knives 32, the rollers 124 are disposed in the inoperative position thereof which is illustrated in FIG. 5, whereas when the concave bevel surfaces 40 are being ground, the rollers 124 are mounted in the operative position which is that shown in FIGS. 2 and 4 and in which position the rollers roll directly along the cutting edge 38 of the knife 32 which is having the concave bevel surface 40 ground thereon. The tensioning mechanism is as follows.

Figure 3:
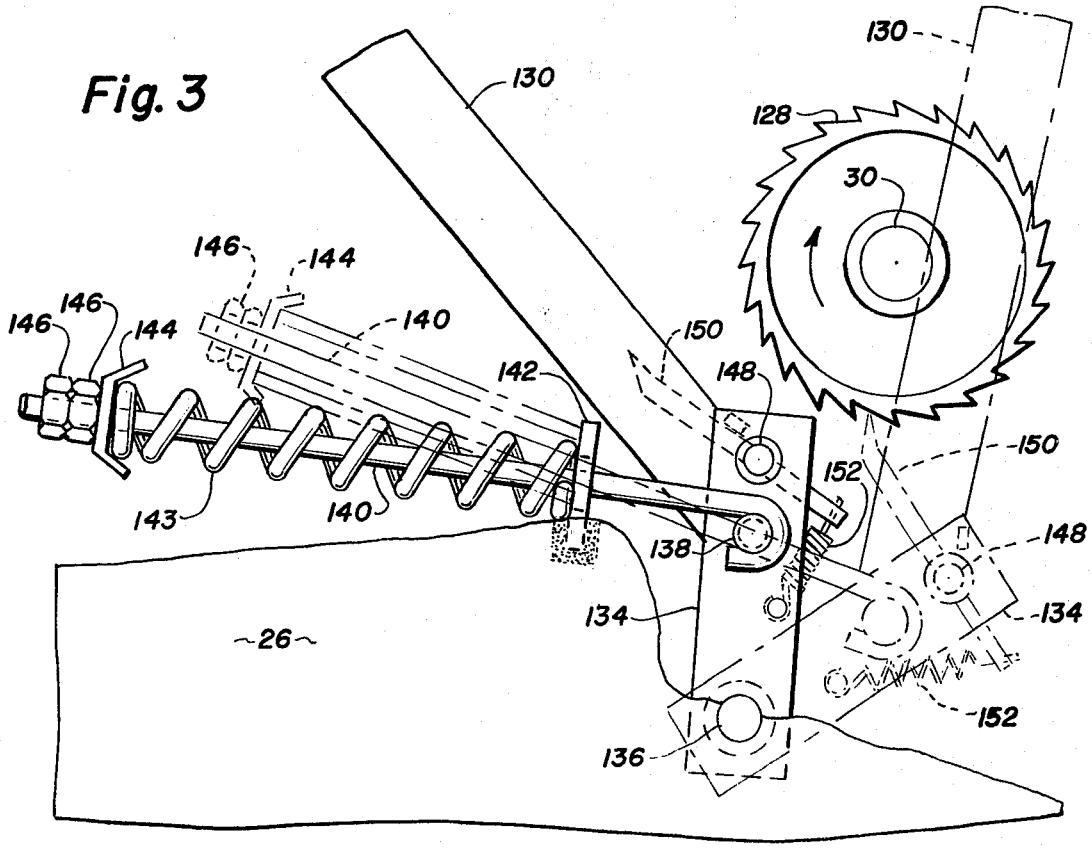
FIG. 3 is still a further enlarged fragmentary side elevation illustrating means by which tension is placed upon the knives of the cutter head incident to grinding the bevel surfaces on the knives, said side elevation being taken on the line 3—3 of FIG. 2.

Fixedly attached to the left hand end of the drive shaft 30 as viewed in FIG. 2 is a ratchet gear 128 which is illustrated in FIGS. 1–3. The handle bar 130 which has a manual engagable grip 132 on the upper end thereof is connected at its lower end to the upper end of a short bar 134. The lower end of bar 134 is pivotally movable about a pintle 136. The bar 134 also has a headed pin 138 projecting from the outer surface thereof and the curved end of a J-bolt 140 extends around said pin. The bolt 140 also extends through an opening in bracket 142 which is fixed to side plate 26. As seen from FIG. 2, the tensioning mechanism for the cutter head is all disposed in enclosed manner between the side plate 20 of hoousing 16 and the outer side plate 26 of the harvester.

A compression spring 143 surrounds the bolt 140 and extends between the bracket 142 and abutment member 144 which is secured adjustably to the outer end of bolt 140 by a pair of nuts 146, one of which is a lock nut. FIG. 3, in full lines, represents the spring 143 in expanded, relaxed position although preferably affording a limited amount of force upon the pin 138 and handle bar 130, preferably to maintain the same in the inoperative position thereof which is that which is shown in FIG. 3 in full lines.

When the handle bar 130 is moved to the right as viewed in FIG. 3, it will compress the spring 143 and the compressed, shortened condition thereof is illustrated in phantom in FIG. 3, such movement of handle bar 130 also moving the short bar 134 to the phantom position shown in FIG. 3.

The upper end of the short bar 134 carries a pivot 148 which pivotally supports a pawl 150. When the handle 130 has been moved to the right, it will be seen that the operative end of pawl 150 is brought into engagement with the ratchet wheel 128 between a pair of successive teeth thereof and the pawl is maintained in said position by a tension spring 152. When the grip 132 is released by the operator, the spring 143 will move the bar 134 and the pawl 150 counter-clockwise and thereby cause the ratchet wheel 128 to be rotated clockwise as indicated by the directional arrow thereon. However, if the roller 124 on the head 62 for the grinding wheel 66 are in engagement with the cutting edge 38 of a knife 32 while traversing said cutting edge 38 thereof, it will be seen that the force of the spring 143 will only tension the knives 132 toward the rollers 124 and threby accurately position the grinding wheel 66 as illustrated in FIG. 4, wherein the grinding wheel will grind the bevel surface 40 of the knife 32 from one end to the other. The grinding of the bevel surface 40 also may be accomplished in both traversing movements of the grinding wheel 66 in order that such grinding may be completed before moving the grinding wheel and carrier to a neutral position, by mechanism described hereinafter, to permit moving the next successive knife 32 into position for the bevel surface 40 to be ground thereon and then the grinding wheel 66 is restored to operative position by the following mechanism.

Referring to FIGS. 1 and 2, it will be seen that opposite ends of the tube 86 are fixed by welding or otherwise respectively to a pair of slotted plates 154. Extending through the tube 86 co-axially is a shaft 156 which is broken intermediately of its end in FIG. 2 in order to disclose part of the mechanism disposed behind the same. Keyed or otherwise fixedly secured to opposite ends of shaft 156 are a pair of bevel gears 158 which are shown in FIG. 2 and also in small size in FIG. 1, said bevel gears meshing with additional bevel gears 160 which are fixed to the adjacent ends of shaft 162 which are threaded and extend through complementarily threaded openings in the opposite ends of lower guide bar 58. The shafts 162 respectively are threaded left hand and right hand, whereby when the shaft 156 is rotated by crank 164, which is fixed to the upper end of the left hand shaft 162 as viewed in FIG. 2, the opposite ends of the lower guide bar 58 will be moved radially, either toward or from the axis of drive shaft 30, about the axis of upper guide bar 58, and thereby dispose the grinding wheel 66 either in the idle, inoperative position such as shown in phantom in FIG. 5, or in operative grinding engagement with the cutting edges 38 of knives 32, or, especially for purposes of the present invention, to dispose the grinding wheel relative to the bevel surfaces 40 of the knives 32. It will be understood of course that adjustment of the grinding wheel 66 toward the cutting edges 38 or bevel surfaces 40 of the knives will be done gradually, at intervals, for purposes of compensating wear sustained by the grinding wheel 66.

From FIG. 3, it also is to be noted that in the event the cutter head 14 is accidentally or otherwise engaged with the prime mover so as to rotate in operative direction, the pawl 150 is so arranged that it will not jam the mechanism and simply by releasing handle grip 132, spring 143 will move the handle bar and pawl to the inoperative position shown in full lines in FIGS. 1 and 3.

While the invention has been described and illustrated in its several preferred embodiments, it should be understood that the invention is not to be limited to the precise details herein illustrated and described since the same may be carried out in other ways falling within the scope of the invention as illustrated and described.

We claim:

1. In a forage harvester of the type having a frame, a shear bar stationarily mounted upon said frame, a cylindrical type cutter head having a plurality of similar knives spaced circumferentially around said head, power means to rotate said head about the axis thereof in shearing engagement of the knives thereof with said shear bar, said knives being skewed to dispose the cutting edges thereof within the circumferential outline of said cutter head and each knife having a similar cutting edge and a bevel surface rearwardly thereof, guide means coextensive with said cutter head mounted in substantially parallel relation to the axis of said cutter head and positioned adjacent the circumferential outline thereof, a head movable along said guide means and rotatably supporting a grinding wheel to grind the cutting edges and bevel surfaces of said knives, power means to rotate said grinding wheel while the same traverses said knives, and means to move said head and grinding wheel relative to said knives; the improvement comprising support means for the opposite ends of said guide means adapted selectively to support the same in a first position parallel to the circumferential outline of the cutting edges of the knives of said cutter head to sharpen said cutting edges and movable to a second position in which one end of said guide means is shifted from said first position thereof to guide said head and grinding wheel along said bevel surfaces of said skewed knives to grind bevel surfaces of uniform depth and width along said skewed knives rearwardly of the newly sharpened cutting edges of said knives.

2. The forage harvester according to claim 1 in which said support means of said improvement comprises an eccentric pivotally movable about an axis parallel to the axis of said cutter head and adjacent said one end of said guide means and operable to shift the position of the same.

3. The forage harvester according to claim 2 in which said guide means comprise a rod along which said head and grinding wheel move longitudinally and said improvement further including an extension on said one end of said guide rod provided with a circular opening complementary to said eccentric and rotatably receiving the same, and a lever connected to said eccentric and operable to move the same rotatably about its axis to shift said one end of said guide rod between said first and second positions of said rod.

4. The forage harvester according to claim 3 in which said improvement further includes stop means positioned upon said harvester to be engaged by said lever respectively to set the limits of shifting said one end of said guide rod between said first and second positions thereof.

* * * * *